US005531623A

United States Patent [19]

Garner et al.

[11] Patent Number: 5,531,623

[45] Date of Patent: Jul. 2, 1996

[54] TOY WELDING APPARATUS WITH SPARKING MECHANISM

[75] Inventors: Harold E. Garner, Long Beach; Michael W. Nuttall, S. Pasadena, both of Calif.

[73] Assignee: Universal Product Innovations, Inc., Carson, Calif.

[21] Appl. No.: 323,333

[22] Filed: Oct. 14, 1994

[51] Int. Cl.[6] ..... A63H 33/36

[52] U.S. Cl. ..... 446/22; 446/144

[58] Field of Search ..... 434/234; 273/856; 156/73.5; 446/85, 22, 86, 23, 87, 145, 90, 144, 91, 236, 108, 118, 242, 243

[56] References Cited

U.S. PATENT DOCUMENTS 1,997,235 4/1935 Schrodel .
2,198,177 4/1940 Pohlhaus .
2,956,611 10/1960 Jendrisak et al. .
3,468,732 9/1969 Hewitt .
3,917,497 11/1975 Stickler .
4,090,898 5/1978 Tuskos .
5,090,934 2/1992 Quercetti ..... 434/370

*Primary Examiner*—John S. Hilten

[57] ABSTRACT

A toy welding apparatus includes a spin welding mechanism which is operative for welding thermoplastic articles together utilizing a rotating thermoplastic rod. The apparatus further includes a sparking mechanism for producing sparks during operation of the spin welding mechanism so that the operation of the welding apparatus realistically simulates that of an arc welding apparatus.

8 Claims, 3 Drawing Sheets

TOY WELDING APPARATUS WITH SPARKING MECHANISM

BACKGROUND AND SUMMARY OF THE INVENTION

The instant invention relates to toys, and more particularly to a toy welding apparatus which is operable in a simulated arc welding operation. It has generally been found that toys which are capable of realistically simulating various industrial operations have relatively high levels of appeal. In this regard, a variety of different toys which simulate industrial tools have been heretofore available and have been found to have significant levels of appeal. However, for the most part, the heretofore available toy industrial tools have been limited to relatively simple hand tools. Further, because of the safety issues involved, the heretofore available toy power tools have generally not been operative for actually performing realistic power tool operations.

The instant invention represents a significant advancement over the heretofore available toy tools by providing an apparatus which is capable of being safely operated by a child for performing a simulated arc welding operation. More specifically, the instant invention provides a toy apparatus which is operable for performing a spin welding operation utilizing a thermoplastic rod and which is further operable for simultaneously producing sparks. Accordingly, the apparatus can be effectively utilized for performing a spin welding operation in which thermoplastic parts or articles are effectively welded together, and it is adapted so that the operation thereof for performing a spin welding operation simulates a more dangerous industrial arc welding operation. As a result, the apparatus of the instant invention has an extremely high level of play value, and it is also capable of performing useful thermoplastic spin welding operations.

Devices representing the closest prior art to the subject invention of which the applicants are aware are disclosed in the U.S. patents to Schrodel, U.S. Pat. No. 1,997,235; Pohlhaus, U.S. Pat. No. 2,198,177; Hewitt, U.S. Pat. No. 3,468,732; Stickler, U.S. Pat. No. 3,917,497; and Tuskos, U.S. Pat. No. 4,090,898. However, since these references fail to even remotely suggest the combination of a spin welding apparatus with a sparking mechanism to provide a simulated arc welding apparatus, they are believed to be of only general interest with respect to the subject invention.

The toy spin welding apparatus of the instant invention more specifically comprises a thermoplastic welding rod, a rotating mechanism for rotating the rod at a sufficient rate to perform a spin welding operation therewith, and a sparking mechanism for producing sparks adjacent to the rod during rotation thereof in order to simulate the performance of an arc welding operation with the apparatus. The rotating mechanism is specifically operative for rotating the rod at a sufficient rate so that when the end thereof is placed in contact with a joint between two articles made from thermoplastic materials which are compatible with the rod, the friction between the rod and the two articles is sufficient to melt the rod and to thereby secure the two articles together. The sparking mechanism of the apparatus is preferably responsive to rotation of the thermoplastic rod for producing sparks. In this regard, the rotating mechanism preferably includes a drive shaft, and the sparking mechanism preferably includes a friction element on the drive shaft and a sparking element, such as a flint, which engages the friction element for producing sparks during rotation of the drive shaft. The drive shaft preferably includes a socket for receiving the thermoplastic rod therein, and the sparking mechanism preferably includes a translucent or transparent forward housing through which the thermoplastic rod passes outwardly. Further, the spark element and the friction element are preferably disposed in the forward housing so that sparks produced by the sparking mechanism are contained therewithin. Still further, the apparatus preferably includes a base housing, a welding gun housing, and an electrical wire connecting the welding gun housing to the base housing. The rotating mechanism preferably includes a battery power supply which is contained in the base housing and a drive motor which is contained in the welding gun housing and electrically connected to the power supply through the electrical wire which extends between the base housing and the welding gun housing.

It has been found that the toy spin welding apparatus of the instant invention can be effectively utilized in a simulated arc welding operation for securing various thermoplastic components together. In this regard, the sparking mechanism adds a new dimension of realism to the apparatus which causes the operation thereof to more closely resemble that of an industrial arc welding apparatus. However, because the apparatus is operative for performing a welding operation utilizing a thermoplastic rod, it can nevertheless be safely operated by children. Still further, because the apparatus is constructed so as to include a base housing and a welding gun housing which are electrically connected through a power supply wire, the overall appearance of the apparatus more closely resembles that of a conventional arc welding apparatus.

Accordingly, it is a primary object of the instant invention to provide a safe, yet realistic, toy welding apparatus.

Another object of the instant invention is to provide a toy spin welding apparatus which includes a sparking mechanism for producing sparks during the operation thereof.

An even still further object of the instant invention is to provide a toy spin welding apparatus which is adapted so that the operation thereof simulates that of an arc welding apparatus.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
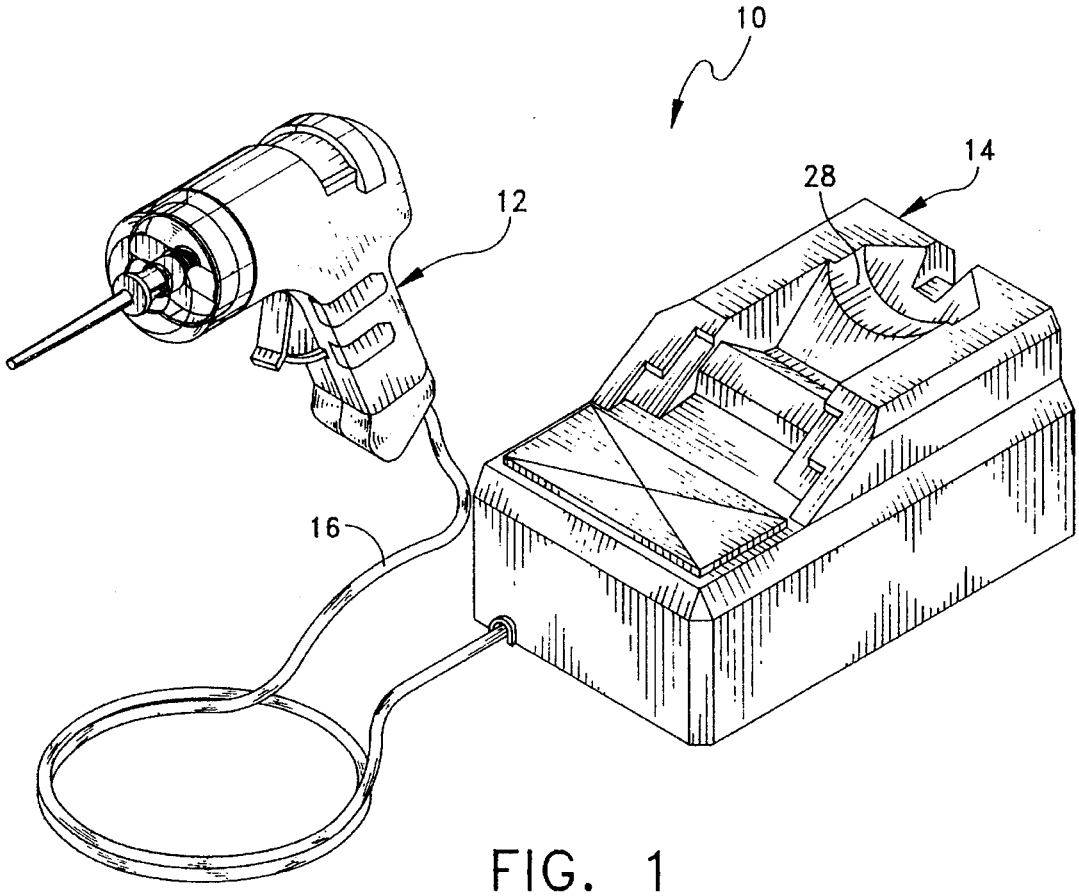
FIG. 1 is a perspective view of the apparatus of the instant invention.
Figure 2:
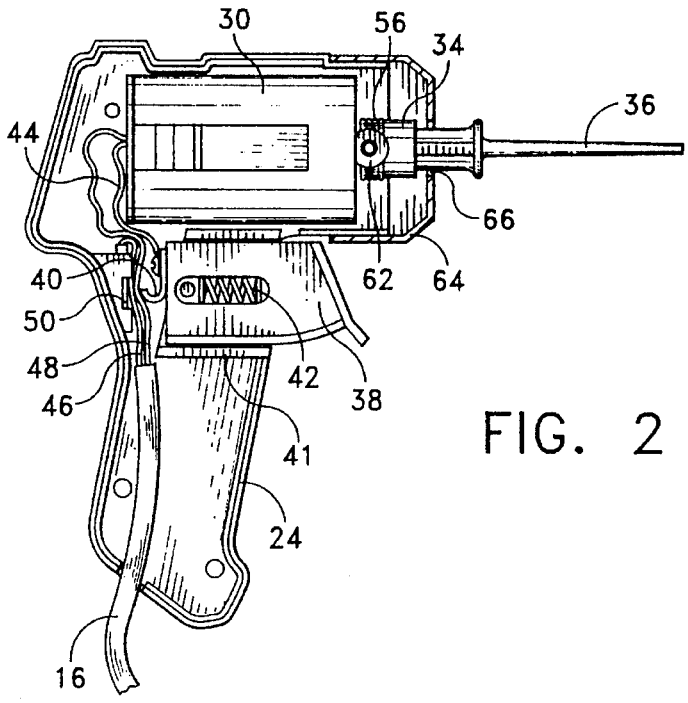
FIG. 2 is a side sectional view of the welding gun portion thereof.
Figure 3:
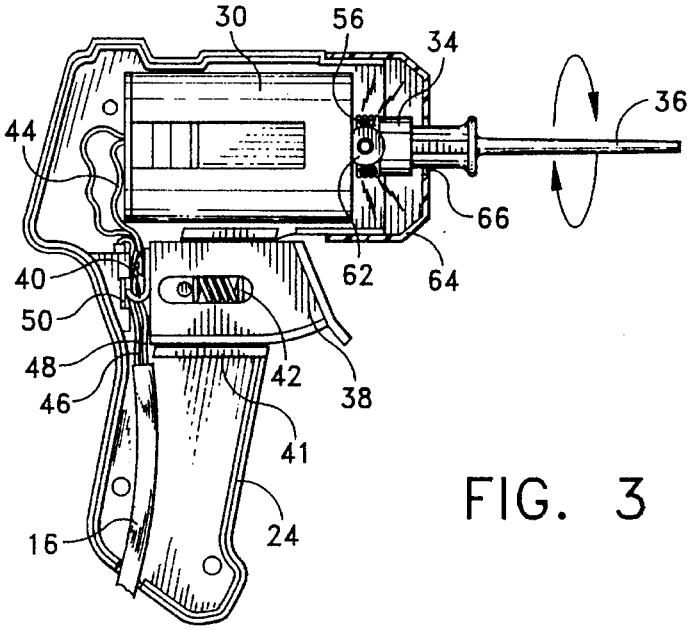
FIG. 3 is a similar side sectional view with the welding gun portion in an actuated condition.

Referring now to the drawings, the spin welding apparatus of the instant invention is illustrated in FIGS. 1–7, and generally indicated at 10 in FIG. 1. The apparatus 10 comprises a welding gun housing generally indicated at 12, a base portion housing generally indicated at 14, and an electrical cable 16 which extends between the welding gun housing 12 and the base portion housing 14. The apparatus 10 further comprises a spin welding mechanism comprising a main welding portion generally indicated at 18 which is contained in the welding gun housing 12 and a power supply portion generally indicated at 20 which is contained in the base portion housing 14. The apparatus 10 still further comprises a sparking mechanism generally indicated at 22 which is mounted on the welding gun housing 12. The apparatus 10 is operative for performing a spin welding operation utilizing the spin welding mechanism contained in the welding gun housing 12 and the base portion housing 14, and the sparking mechanism 22 is simultaneously operative for producing sparks in order to cause a spin welding operation performed with the apparatus 10 to simulate an industrial arc welding operation.

The welding gun housing 12 comprises left and right housing sections 24 and 26, respectively, which are formed to simulate a pistol-like housing for containing the main portion 18 of the spin welding apparatus and the sparking mechanism 22.

The base housing 14 is formed to resemble a base arc welding unit, and it provides a convenient housing for containing the battery power supply 20. The base housing 14 includes a recessed area 28 which is adapted for receiving the welding gun housing 12 and the related components, including the main welding portion 18, and the sparking mechanism 22, in a storage position. The base housing 14 further includes a removable access door (not shown) on the under side thereof for assembling a plurality of batteries of the battery power supply 20 therein in a conventional manner.

The main portion 18 of the spin welding mechanism is illustrated most clearly in FIGS. 2–4 and 6. The main portion 18 comprises a drive motor 30 having a drive shaft 32, a socket 34 on the drive shaft 32, and a spin welding rod 36 which is releasably receivable in the socket 34. The main portion 18 further comprises a trigger 38 having a movable contact 40 thereon. The trigger 38 is slidably mounted in tracks 41, and it is biased to a forward position with a spring 42, and the contact 40 is electrically connected to the drive motor 30 with a wire 44. The electrical cable 16 extends into the housing 12, and it includes first and second conductor wires 46 and 48, respectively. The first wire 46 is connected to a stationary contact 50, and the second wire 48 is electrically connected to the drive motor 30. The stationary contact 50 is mounted in the handle portion of the housing 12 so that it is engageable by the movable contact 40 when the trigger 38 is drawn rearwardly. Accordingly, the trigger 38 is operative for causing the first conductor wire 46 to be electrically connected to the motor 30 through the contacts 40 and 50 in order to energize the motor 30 in a conventional manner.

Figure 4:
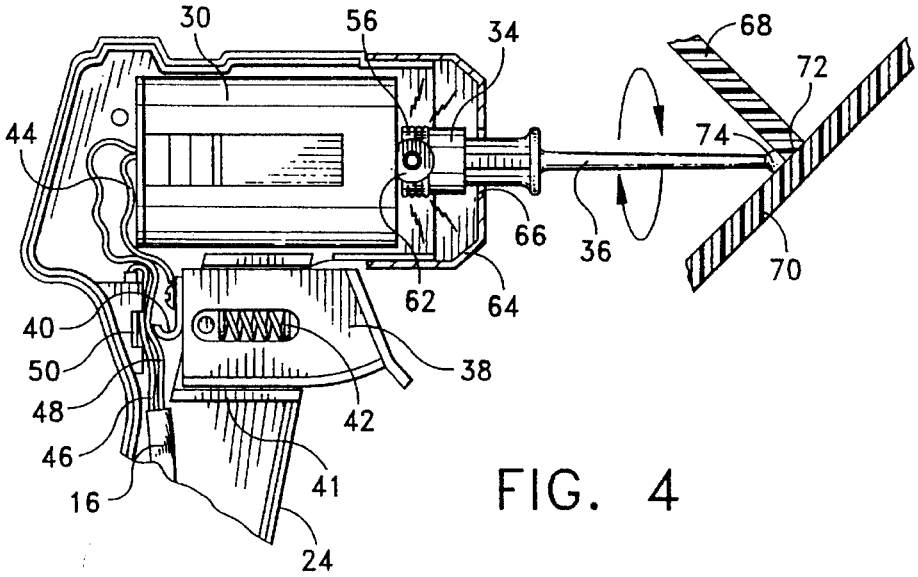
FIG. 4 is an enlarged similar sectional view of the welding gun portion during a welding operation.

The spin welding rod 36 is made from a suitable thermoplastic material for enabling it to be effectively utilized to carry out a conventional spin welding operation in which two articles made from compatible thermoplastic materials are welded together in the manner illustrated in FIG. 4. Accordingly, the spin welding rod 36 can be made from a variety of different thermoplastic materials, although it can normally only be utilized for welding other thermoplastic materials which are compatible with the material from which the rod 36 is constructed. The general compatibility of various thermoplastic materials and their use in spin welding operations is relatively well known in the art as, for example, shown by the teachings of the above-cited Hewitt, U.S. Pat. No. 3,468,732.

The power supply portion 20 of the spin welding mechanism comprises a plurality of conventional D size batteries 52 which are electrically connected in series relation to the power cable 16 through contacts 54.

The sparking mechanism 22 comprises a friction wheel on the drive shaft 32, a pair of flint sparking elements 58, a pair of biasing springs 60, and a pair of flint guide tubes 62 on the forward end of the welding gun housing 12. The flint sparking elements 58 are slidably received in the guide tubes 62, and the springs 60 are received in the tubes 62 for biasing the flint elements 58 against the friction wheel 56. The friction wheel 56 has a knurled or otherwise roughened circumferential surface thereon, and accordingly, when the motor 30 is energized, the flint elements 58, which bear on the friction wheel 56, function to produce sparks adjacent the spin welding rod 36 at the forward end of the welding gun housing 12. In this regard, the outer ends of the springs 60 are contained by the forward portions of the housing 12 so that they effectively bias the flint elements 58 against the friction wheel 56. The sparking mechanism 22 further comprises a translucent (preferably transparent) housing 64 having a forward opening 66 therein. The housing 64 is received on the forward end of the welding gun housing 12 so that it surrounds the socket 34, the friction wheel 56, and the flint elements 58. Accordingly, the housing 64 contains any sparks produced by the flints 58 and the friction wheel 56 during a spin welding operation. However, the housing 64 nevertheless allows the sparks generated by the sparking mechanism 22 to be clearly visible at the forward end of the welding gun housing 12. Further, the spin welding rod 36 projects forwardly through the opening 66 so that the sparks produced by the sparking mechanism 22 are produced adjacent the base of the spin welding rod 36.

Figure 5:
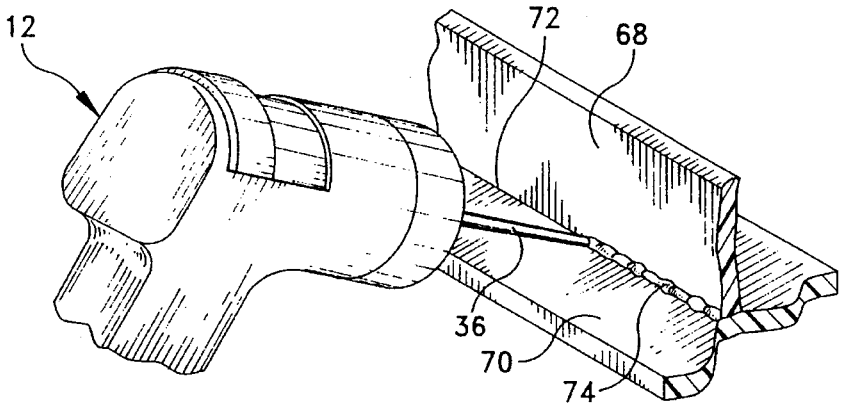
FIG. 5 is a perspective view of the operation of the apparatus.
Figure 6:
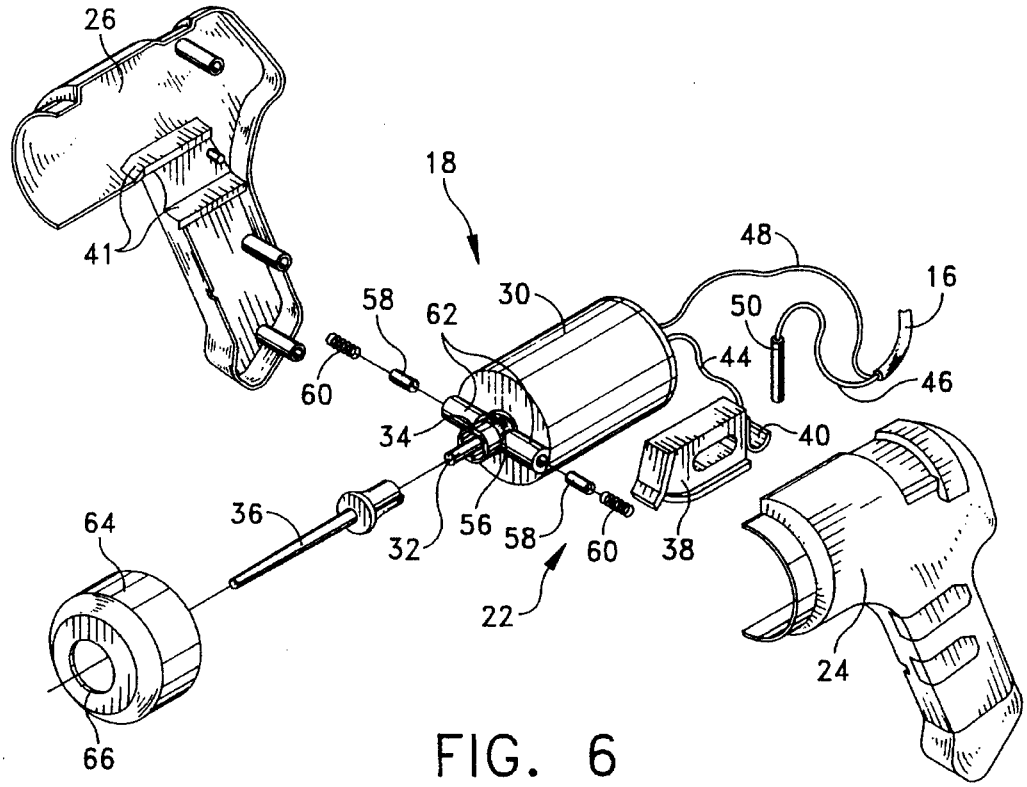
FIG. 6 is an exploded perspective view of the welding gun portion.
Figure 7:
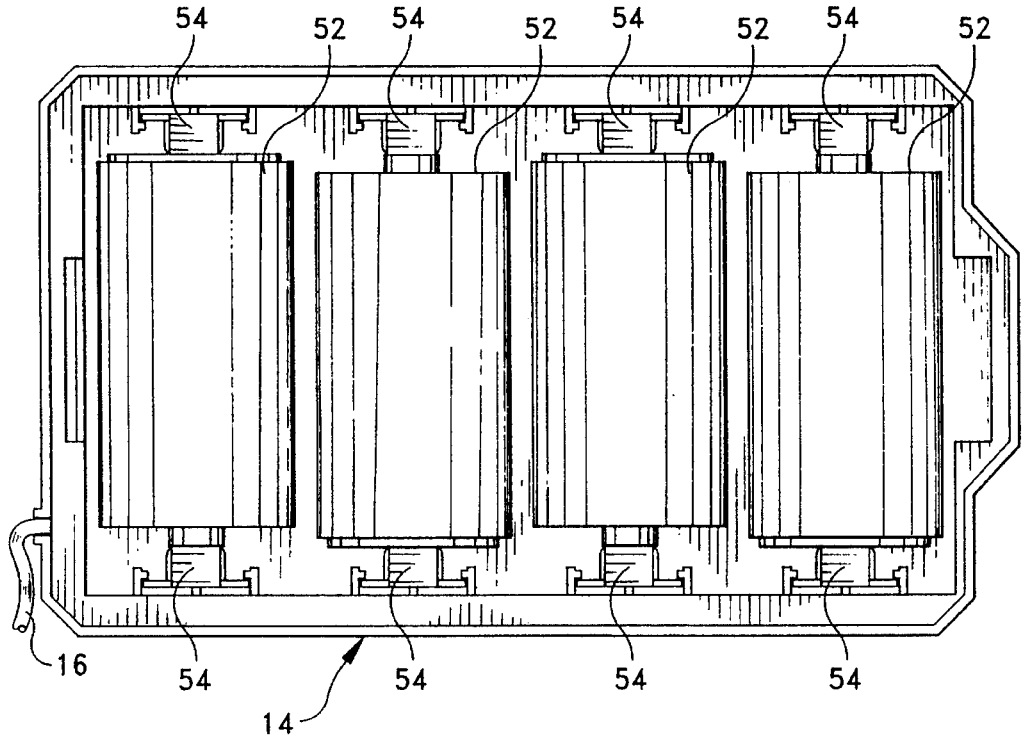
FIG. 7 is a sectional view of the base housing section.

The use and operation of the spin welding apparatus 10 for welding first and second thermoplastic articles 68 and 70 together is illustrated in FIGS. 4 and 5. As will be seen, in order to operate the apparatus 10, the forward end of the spin welding rod 36 is placed in engagement with the articles 68 and 70 at a junction or a seam area 72 therebetween. The trigger 38 is then drawn rearwardly in the tracks 41 to cause the movable contact 40 to mate with the stationary contact 50 whereby the motor 30 is electrically energized with the battery power supply 20. As the welding rod 36 is rapidly rotated by the motor 30, the frictional engagement of the tip of the rod 36 with the articles 68 and 70 causes sufficient heat to be generated to temporarily melt the tip portions of the rod 36. As a result, a bead 74 of melted material is formed at the tip of the rod 36 which adheres to the articles 68 and 70 to weld them together. Further, by advancing the rod 36 along the longitudinal extent of the seam area 72 between the elements 68 and 70, an entire welded seam can be formed in order to more completely weld the articles 68 and 70 together.

It is seen, therefore, that the instant invention provides an effective and realistic welding apparatus. The spin welding apparatus 10 is operative for spin welding thermoplastic components together utilizing a thermoplastic welding rod. However, because the apparatus 10 also includes the sparking mechanism 22 for producing sparks as the welding rod 36 is rotated, the apparatus 10 also has the effect of resembling an arc welding apparatus in its operation. Accordingly, the apparatus 10 has a high level of play value, and it can also be effectively utilized for welding thermoplastic components together. Hence, it is seen that the spin welding apparatus 10 represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy spin welding apparatus comprising:

a thermoplastic rod having an end;

rotating means for rotating said rod at a rate sufficient so that when said end is placed in contact with a joint between two articles made from thermoplastic materials which are compatible with said rod, the friction between said rod and said two articles is sufficient to melt said rod and to thereby weld said two articles together; and sparking means on said rotating means for producing sparks when said rotating means is actuated so as to cause the operation of said apparatus to simulate that of an arc welder.

2. In the toy spin welding apparatus of claim 1, said rotating means including a drive shaft, said sparking means being responsive to rotation of said drive shaft for producing sparks.

3. In the toy spin welding apparatus of claim 1, said sparking means including a friction element and a spark element, said friction element engaging said spark element for producing sparks therefrom, one of said friction element and said spark element rotating with said drive shaft, the other one of said friction element and said spark element remaining stationary during rotation of said drive shaft.

4. In the apparatus of claim 1, said rotating means including receiving means for receiving said thermoplastic rod in engagement therein, said sparking means being located adjacent said receiving means and including a translucent housing, said rod passing outwardly through said housing, said sparking means producing sparks in said housing.

5. In the apparatus of claim 3, said sparking means further including a translucent housing, said spark element and said friction element being located in said housing.

6. In the apparatus of claim 3, said friction element comprising a friction wheel on said drive shaft, said spark element comprising a flint element engaging said friction wheel for producing sparks as said friction wheel is rotated.

7. The toy spin welding apparatus of claim 1 further comprising a base housing, a welding gun housing and electrical wire means connecting said base housing and said welding gun housing, said rotating means including a battery power supply in said base housing and a drive motor in said welding gun housing, said drive motor being electrically powered by said battery power supply through said electrical wire means and being operative for rotating said thermoplastic rod.

8. A toy spin welding apparatus comprising:

spin welding means operable for welding first and second thermoplastic components and including a welding rod made of a thermoplastic material which is compatible with the thermoplastic materials of said first and second components and means for rotating said welding rod to weld said first and second components together with said welding rod; and sparking means for producing sparks adjacent said welding rod during rotation thereof so as to cause the operation of said apparatus to simulate that of an arc welding apparatus.

* * * * *